US005944623A

United States Patent [19]

Schlicting

[11] Patent Number: 5,944,623

[45] Date of Patent: Aug. 31, 1999

[54] COMBINATION QUICK CONNECTED/ DISCONNECT BASKETBALL NET AND TOTE BAG AND METHOD THEREFOR

[76] Inventor: Michael Schlicting, 3465 NE. Davis St., Portland, Oreg. 97232

[21] Appl. No.: 09/039,101

[22] Filed: Mar. 13, 1998

[51] Int. Cl.[6] ..... A63B 63/08

[52] U.S. Cl. ..... 473/489; 473/402

[58] Field of Search ..... 473/479, 485, 473/488, 487, 489; 273/398, 400, 401, 402

[56] References Cited

U.S. PATENT DOCUMENTS 4,940,232 7/1990 Chen ..... 273/400 X 5,098,108 3/1992 McKinney ..... 273/400

*Primary Examiner*—William H. Grieb

*Attorney, Agent, or Firm*—Harry M. Weiss; Paul W. Davis; Jeffrey Weiss

[57] ABSTRACT

A basketball net which may be used as a tote bag. The basketball net has a bottom cord which is coupled to the bottom loops of a basketball net. The bottom cord is used as a drawstring to close the bottom section of the basketball net in order to hold a basketball or other objects placed in the basketball net. The basketball net may further have a quick connect/disconnect system coupled to the top loops of the basketball net for easily and quickly attaching and removing the basketball net from the basketball rim.

15 Claims, 1 Drawing Sheet

COMBINATION QUICK CONNECTED/ DISCONNECT BASKETBALL NET AND TOTE BAG AND METHOD THEREFOR

BACKGROUND OF THE INVENTION

1. Field of the Invention

This invention relates generally to sports equipment and, more specifically, to a basketball net which may be easily connected and disconnected from a basketball rim and which may further be used as a tote bag for carrying a basketball and other types of items.

2. Description of the Prior Art

Basketball is one of the most popular sports currently being played. Everyday, children and adults go down to the local playground to shoot some "hoops" and to play in "pick-up" games. A problem with playing basketball outdoors is that in many outdoor basketball courts, it is extremely difficult to keep a basketball net attached to the basketball rim. This is mainly due to individuals stealing the basketball nets off of the basketball rim, or due to heavy usage and harsh weather conditions which cause the basketball nets to degrade and break.

Most basketball players prefer to have a basketball net attached to the basketball rim. The use of a basketball net avoids any controversy as to whether a basketball shot by a player was or was not successful. However, as stated above, many outdoor courts do not have basketball nets and installing a basketball net prior to playing is difficult and time consuming.

Another problem with playing basketball is that most children and adults don't like carrying all of the equipment down to the local playground to play basketball. Most people like to take a basketball, water, and other equipment to the court when they play. However, carrying all of this equipment down to the local outdoor basketball court is cumbersome.

Therefore, a need existed to provide an improved basketball net. The improved basketball net must be easy to connect and remove from the basketball rim in a minimal amount of time. The improve basketball net must also function as a tote bag for carrying basketball equipment to and from the basketball court. The improved basketball net must further provide space on which advertisements may be shown.

SUMMARY OF THE INVENTION

In accordance with one embodiment of the present invention, it is an object of the present invention to provide an improved basketball net.

It is another object of the present invention to provide an improved basketball net that is easy to connect and remove from the basketball rim in a minimal amount of time.

It is still another object of the present invention to provide an improved basketball net that also functions as a tote bag for carrying basketball equipment to and from the basketball court.

It is still another object of the present invention to provide an improved basketball net that provides space on which advertisements may be shown.

BRIEF DESCRIPTION OF THE PREFERRED EMBODIMENT

In accordance with one embodiment of the present invention, a basketball net which may be used as a tote bag is disclosed. The basketball net has a bottom cord which is coupled to the bottom loops of the basketball net. The bottom cord is used as a drawstring to close the bottom section of the basketball net in order to hold a basketball or other objects placed in the basketball net. The basketball net may further have a quick connect/disconnect system coupled to the top loops of the basketball net for easily and quickly attaching and removing the basketball net from the basketball rim.

In accordance with another embodiment of the present invention, a method of providing a basketball net which may be used as a tote bag is disclosed. The method comprises the steps of: providing a basketball net; and providing a bottom cord coupled to bottom loops of the basketball net for forming a drawstring which may be used to close a bottom section of the basketball net.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENT

Figure 1:
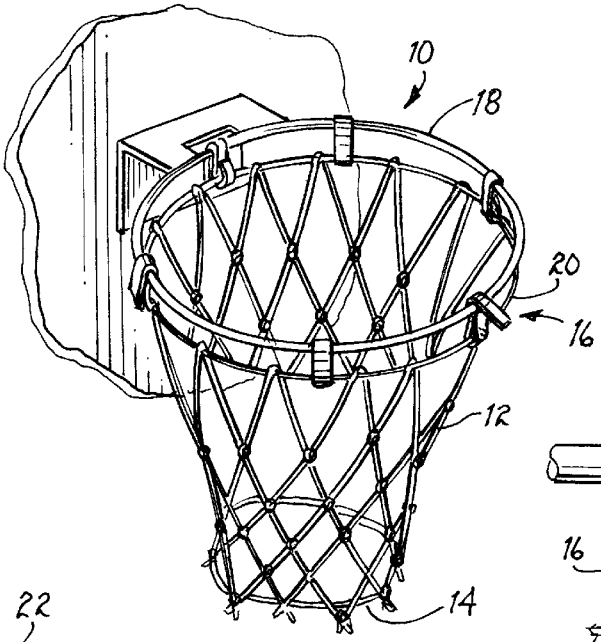
FIG. 1 is an elevated perspective view of the combination basketball net and tote bag of the present invention being used as a basketball net.
Figure 4:
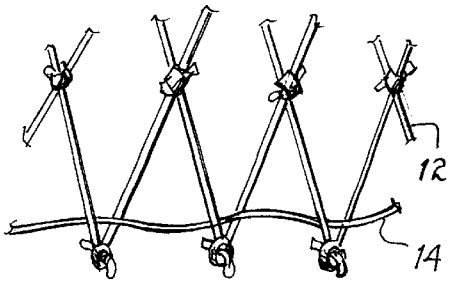
FIG. 4 shows a magnified view of the drawstring used with the combination basketball net and tote bag depicted in FIG. 1.

Referring to the figures wherein like numerals and symbols represent like elements, a combination basketball net and tote bag 10 is shown (hereinafter combination 10). The combination 10 is designed to be used as a basketball net, which can be easily connected to and removed from a basketball rim 18, and as a tote bag for carrying a basketball and other objects when the combination 10 is removed from the basketball rim.

The combination 10 uses a basketball net 12. In the preferred embodiment of the present invention, the basketball net 12 is a standard basketball net which is sized to fit on a standard basketball rim 18. The basketball net 12 may be made from a plurality of different materials (i.e., cotton, chain links, etc.). However, nylon is the preferred material.

Figure 5:
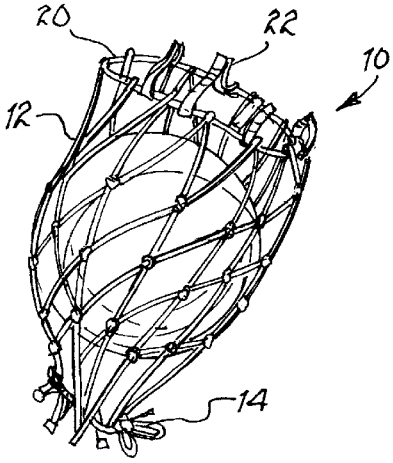
FIG. 5 shows an elevated perspective view of the combination basketball net and tote bag of the present invention being used as a tote bag.

The combination 10 has a bottom string 14. The bottom string 14 is coupled to a bottom portion of the basketball net 12. Preferably, the bottom string 14 is threaded through the bottom loops of the basketball net 12. The bottom string 14 is generally made from the same material as the basketball net. However, like the basketball net 12, the bottom string 14 may be made from any number of different materials. The bottom string 14 is designed to be used as a drawstring. When the combination 10 is to be used as a tote bag (FIG. 5), the bottom string is tightened and tied together. This effectively closes the bottom section of the basketball net 12, thereby preventing a basketball or other objects placed in the basketball net 12 from falling out of the bottom section of the basketball net 12.

The combination 10 may further have a quick connect/disconnect device 16 coupled to a top section of the basketball net 12. The quick connect/disconnect device 16 is used to quickly and easily attach and remove the basketball net 12 to and from a basketball rim 18. As stated above in the Description of the Prior Art, on many outdoor basketball courts, the basketball net is missing. Thus, the quick connect/disconnect device 16 allows the combination 10 to be easily attached to the basketball rim 18 when the individuals are playing and removed from the basketball rim 18 when the individuals are finished.

The quick connect/disconnect device 16 has a top string 20 which is coupled to a top portion of the basketball net 12. Preferably, the top string 20 is threaded through the top loops of the basketball net 12. Both ends of the top string 20 are threaded through the top loops of the basketball net 12 and are coupled together to form a loop. The loop formed by the top string 20 should have a diameter approximately equal to the diameter of a standard regulation basketball rim 18. The top string 20 is generally made from the same material as the basketball net. However, like the basketball net 12, the top string 20 may be made from any number of different materials.

Figure 3:
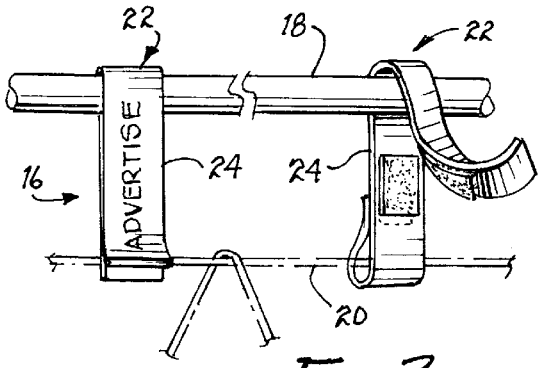
FIG. 3 is a frontal view of the quick connect/disconnect devices of FIG. 2 connecting the combination basketball net and tote bag to a basketball rim.
Figure 2:
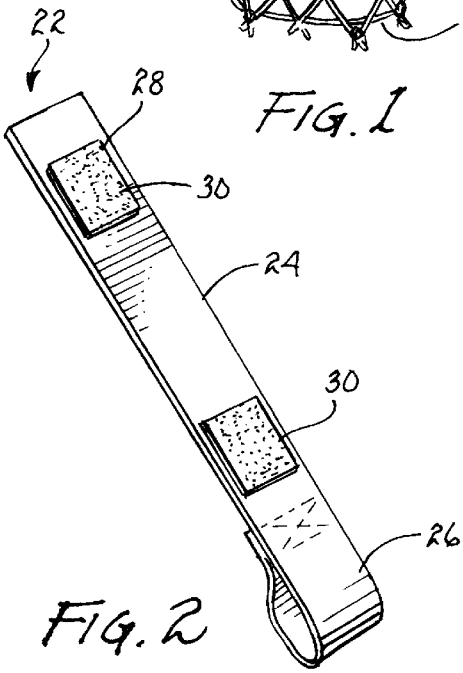
FIG. 2 is an elevated perspective view of a quick connect/disconnect device used in the combination basketball net and tote bag depicted in FIG. 1.

The quick connect/disconnect device 16 further has a plurality of fasteners 22 coupled to the top string 20. The fasteners 22 are spaced along the entire circumference of the top string. The fasteners 22 are used to quickly and easily attach and remove the basketball net 12 to the basketball rim 18. As can be seen more clearly in FIGS. 2 and 3, in the preferred embodiment of the present invention, each of the fasteners 22 are comprised of a strip of material 24. Each strip 24 should be of sufficient width to support a section of the basketball net 12. Each strip 24 should also be of sufficient width to allow corporations and sporting good manufacturers to place advertisements on each strip 24. Each strip 24 has a first end 26 and a second end 28. The first end 26 of the strip of material 24 is folded over the top string 20 and sown together thereby allowing the strips of material 24 to support the basketball net 12. Located above the folded portion on each strip 24 and on the second end 28 of each strip 24 is a combination of hook and loop material 30 (an example of hook and loop material is VELCRO). By folding each strip 24 over the basketball rim 18 and coupling the hook and loop material 30 together, the basketball net 12 can be easily connected and later removed from the basketball rim 18. It should be noted that other types of connecters could be used to connect the two ends of the strips 24 together.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A basketball net which may further be used as a tote bag comprising, in combination:

a basketball net;

a bottom cord coupled to bottom loops of said basketball net for forming a drawstring which may be used to close a bottom section of said basketball net; and a quick connect/disconnect system for easily and quickly attaching and removing said basketball net from a basketball rim, said quick connect/disconnect system comprising:

a top cord having a first end and a second end wherein said first end and said second end are placed through top loops of said basketball net, said first end and said second end being coupled together to form a loop having a diameter approximately equal to a diameter of said basketball rim; and a plurality of quick fastening devices spaced along and coupled to said top cord for quickly attaching and removing said basketball net from said basketball rim.

2. A basketball net in accordance with claim 1 wherein said bottom cord is made from a same material as said basketball net.

3. A basketball net in accordance with claim 1 wherein said basketball net is a nylon cord basketball net.

4. A basketball net in accordance with claim 1 wherein each of said plurality of quick fastening devices comprises:

a strap having a first end and a second end; and hook and loop fasteners coupled to said first end and said second end of said strap for quickly and easily attaching and removing said basketball net from said basketball rim.

5. A basketball net in accordance with claim 4 wherein said hook and loop fasteners are VELCRO.

6. A basketball net in accordance with claim 4 wherein said strap is further used to display advertisements.

7. A basketball net which may further be used as a tote bag comprising, in combination:

a basketball net;

a bottom cord coupled to bottom loops of said basketball net for forming a drawstring which may be used to close a bottom section of said basketball net; and a quick connect/disconnect system for easily and quickly attaching and removing said basketball net from a basketball rim, said quick connect/disconnect system comprising:

a top cord having a first end and a second end wherein said first end and said second end are placed through top loops of said basketball net, said first end and said second end being coupled together to form a loop having a diameter approximately equal to a diameter of said basketball rim; and a plurality of quick fastening devices spaced along and coupled to said top cord for quickly attaching and removing said basketball net from said basketball rim, each of said plurality of quick fastening devices comprising:

a strap having a first end and a second end; and hook and loop fasteners coupled to said first end and said second end of said strap for quickly and easily attaching and removing said basketball net from said basketball rim.

8. A basketball net in accordance with claim 7 wherein said hook and loop fasteners are VELCRO.

9. A basketball net in accordance with claim 7 wherein said strap is further used to display advertisements.

10. A basketball net in accordance with claim 7 wherein said basketball net is a nylon cord basketball net.

11. A basketball net in accordance with claim 10 wherein said bottom cord and said top cord are both made from a same material as said basketball net.

12. A method of providing a basketball net which may be used as a tote bag comprising the steps of:

providing a basketball net;

providing a bottom cord coupled to bottom loops of said basketball net for forming a drawstring which may be used to close a bottom section of said basketball net;

providing a quick connect/disconnect system for easily and quickly attaching and removing said basketball net from a basketball rim, wherein said step of providing a quick connect/disconnect system further comprises the steps of:

providing a top cord having a first end and a second end wherein said first end and said second end are placed through top loops of said basketball net, said first end and said second end being coupled together to form a loop having a diameter approximately equal to a diameter of said basketball rim; and providing a plurality of quick fastening devices spaced along and coupled to said top cord for quickly attaching and removing said basketball net from said basketball rim.

13. The method of claim 12 wherein each of said plurality of quick fastening devices further comprises the steps of:

providing a strap having a first end and a second end; and providing hook and loop fasteners coupled to said first end and said second end of said strap for quickly and easily attaching and removing said basketball net from said basketball rim.

14. The method of claim 13 wherein said hook and loop fasteners are VELCRO.

15. The method of claim 13 wherein said strap is further used to display advertisements.

* * * * *

UNITED STATES PATENT AND TRADEMARK OFFICE

CERTIFICATE OF CORRECTION

PATENT NO. : 5,944,623
DATED : 08-31-99
INVENTOR(S) : SCHLICTING, MICHAEL

It is certified that error appears in the above-identified patent and that said Letters Patent is hereby corrected as shown below:

On the title page, item [54] and Column 1 third word of the title: change

CONNECTED/ to CONNECT/

Signed and Sealed this
Fourth Day of January, 2000

*Attest:*

*Attesting Officer*

*Acting Commissioner of Patents and Trademarks*